United States Patent [19]

Shinada

[11] Patent Number: 4,838,716

[45] Date of Patent: Jun. 13, 1989

[54] RIBBON CARTRIDGE FOR A PRINTER

[75] Inventor: Mikio Shinada, Kamakura, Japan

[73] Assignee: Mitsubishi Denki Kabushiki Kaisha, Japan

[21] Appl. No.: 198,658

[22] Filed: May 19, 1988

Related U.S. Application Data

[63] Continuation of Ser. No. 907,836, Sep. 16, 1986, abandoned.

[30] Foreign Application Priority Data

Mar. 4, 1985 [JP] Japan ..... 60-48596

[51] Int. Cl.[4] ..... B41J 35/28

[52] U.S. Cl. ..... 400/208; 400/236

[58] Field of Search ..... 400/208, 208.1, 223, 400/225, 234, 235, 235.1, 236

[56] References Cited

U.S. PATENT DOCUMENTS

| | | | |
|---|---|---|---|
| 4,010,839 | 3/1977 | Guerrini et al. | 400/208 |
| 4,299,504 | 11/1981 | Behz et al. | 400/208 |
| 4,351,619 | 9/1982 | Duke et al. | 400/235.1 |
| 4,397,574 | 8/1983 | Wojdyla | 400/235.1 |
| 4,406,554 | 9/1983 | Dreinhoff et al. | 400/236 |
| 4,428,695 | 1/1984 | Jamieson | 400/279 |
| 4,465,388 | 8/1984 | Iwasawa | 400/235.1 |
| 4,523,868 | 6/1985 | Shadwick | 400/208 |
| 4,655,623 | 4/1987 | Gasser | 400/208 |

FOREIGN PATENT DOCUMENTS

| | | | |
|---|---|---|---|
| 155985 | 9/1983 | Japan | 400/208 |
| 58-191181 | 11/1983 | Japan . | |
| 73984 | 4/1984 | Japan | 400/235.1 |

*Primary Examiner*—David A. Wiecking

*Attorney, Agent, or Firm*—Leydig, Voit & Mayer

[57] ABSTRACT

A ribbon cartridge for a printer is disclosed which is low in production cost and which is applicable to various kinds of ribbons including one-time ribbons and multiuse ribbons, and in which loadability of the ribbon cartridge in a printer is improved, and in which it is easy to remedy slack in the printing portion of a ribbon. The ribbon cartridge includes a cartridge casing housing therein a ribbon-feeding member and a ribbon-winding member with a printing ribbon entrained therebetween, the cartridge casing having a lid member detachably secured thereto. A projectionless ribbon-feeding roller is rotatably mounted on the cartridge casing and has its outer periphery formed of a high friction material such as rubber. The ribbon-feeding roller is adapted to be housed in the cartridge casing with a part thereof exposed outwardly of the cartridge casing. The ribbon-feeding roller is detachably supported by the cartridge casing and placed in pressure engagement with the winding side of the ribbon wound around the ribbon-winding member.

4 Claims, 2 Drawing Sheets

RIBBON CARTRIDGE FOR A PRINTER

This application is a continuation of application Ser. No. 907,836, filed Sept. 16, 1986, now abandoned.

BACKGROUND OF THE INVENTION

1. Field of the Invention

This invention relates to a ribbon cartridge for a printer such as, for example, a thermal printer particularly adapted to be connected with an electronic computer for printing out the output thereof.

2. Description of the Prior Art

In general, many ink ribbon cartridges (referred to as ribbon cartridges hereinafter) for thermal-transfer serial printers of the line-sequential type and the ribbon-feeding mechanisms for such ribbon cartridges basically resemble compact audio tape cartridges and tape-feeding mechanisms for such audio cartridges, respectively. Specifically, such a ribbon-feeding mechanism includes a capstan and a pinch roller for feeding a ribbon at a constant speed or quantity, a friction clutch mechanism mounted on a shaft for a winding spool for transmitting a constant winding torque from a drive source to the winding spool shaft at all times so that the quantity of the ribbon wound around the shaft is adjusted at a constant level irrespective of the changing effective diameter of the ribbon wound around the winding spool. However, the ribbon-feeding mechanism of this type is disadvantageous in that it is complicated in construction and expensive to produce.

In order to eliminate the above-mentioned disadvantages, a proposal has been made for the system illustrated in FIG. 5. In this Figure, the ribbon-feeding mechanism as illustrated includes a ribbon-feeding roller 1, a winding side 2A of a ribbon, a coiled torsion spring 3 adapted to place the winding side 2A of the ribbon into pressure engagement with the ribbon-feeding roller 1, a feeding side 4 of the ribbon, a printing portion 5 of the ribbon extending from the feeding side 4 to the winding side 2A, a ribbon cartridge casing 6 receiving therein the above-described component members except for the ribbon-feeding roller 1, a printing head 7, a ribbon guide 8, a platen 9, and a printing paper 10 wound around the platen 9. Besides the above component members, there are housed in the ribbon cartridge casing 6 a tension mechanism (not shown) for applying a tension of a constant value to the printing portion 5 of the ribbon, and a brake mechanism (not shown) for preventing unnecessary rotation of the feeding-side ribbon 4 so as to avoid wasteful ribbon feed.

With the above construction, the printing portion 5 of the ribbon is mounted on the printing head 7 and the ribbon guide 8 in the manner as shown in FIG. 5 so that when the printing head 7 is placed by a printing command into pressure engagement with the printing paper 10, the printing portion 5 of the ribbon is intermediate the head and paper. Thereafter, the printing head 7 and the ribbon guide 8 are moved from the left to the right in FIG. 5 with their relative positions remaining unchanged, whereby the ink on the printing portion 5 of the ribbon is transferred to the printing paper 10, thus printing letters thereon. Upon completion of printing on the paper 10, the movement of the printing head 7 and the ribbon guide 8 is stopped and the printing head 7 and the printing portion 5 of the ribbon are moved away from the the printing paper 10. Then, the printing paper 10 is fed at a predetermined amount by rotation of the platen 9 so as to bring up a new printing line.

Subsequently, the printing head 7 and the ribbon guide 8 are moved from the right to the left in FIG. 5 to return to their initial positions, and simultaneously with this return movement, the ribbon-feeding roller 1 is caused to rotate in the counterclockwise direction in FIG. 5 so that the winding side 2A of the ribbon, being placed in pressure engagement with the ribbon-feeding roller 1 under the action of the coiled torsion spring 3, is forced to rotate in the clockwise direction in FIG. 5 thereby to move the printing portion 5 of the ribbon from the right to the left in FIG. 5 for winding thereof. The printing head 7 and the ribbon guide 8 are returned to their next print-starting positions and stopped there. Simultaneously with this, the rotation of the ribbon-feeding roller 1 is also stopped and the printing operation on one line is thus completed. Thereafter, the above-described operations are repeated by means of a printing command, and the amount of the winding side 2A of the ribbon wound increases accordingly up to a fully-wound condition indicted by the dotted line 2B in FIG. 5.

In the above-described operations, the reciprocating movement of the printing head 7 and the winding of the ribbon can be effected by a single drive source such as, for example, a stepping motor, i.e. by the forward or reverse rotation of the motor. Specifically, during printing operation, the winding of the ribbon is interrupted under the action of a one-way clutch (not shown), and during the return stroke, the return of the printing head 7 and the winding of the ribbon can be concurrently effected. Of course, these operations may also be made by respective independent drive sources.

The thermal printing ribbon is a one-time ribbon and hence it is required that the above-described winding amount of the ribbon be greater than the returning amount of the printing head 7 so that a used portion of the ribbon is not placed in a printing portion again. In this connection, the above-mentioned conventional ribbon cartridge has a major feature in that such a requirement can be met by taking into account only the angle of rotation of the ribbon-feeding roller 1 irrespective of the diameter of the wound ribbon 2A.

In the conventional ribbon-feeding mechanism of the above kind, the ribbon-feeding roller 1 employed comprises a toothed roller which is formed of a metal disc about 0.2 to 0.5 mm thick and having saw teeth formed in its outer peripheral portion, as illustrated in FIG. 5. Otherwise, the ribbon-feeding roller 1 may comprise a shaft having a plurality of short pins implanted radially on its outer peripheral surface. In either case, productivity is low and the cost of manufacturing becomes high.

Further, when the ribbon cartridge is not in use or is not loaded in a printer, the winding side 2A of the ribbon 2A is displaced by the torsion spring 3 toward the position indicated by the dotted line 2C wherein the ribbon 2A abuts against the peripheral wall of the cartridge casing 6. For loading of the cartridge in a printer, the ribbon-feeding roller 1 is moved away from its operating position shown in FIG. 5 in a direction indicated by an arrow and then the ribbon cartridge is loaded in the printer from above, or the ribbon cartridge is slid laterally and set in place in the printer, or the winding side of the ribbon displaced to the dotted-line position 2C is first slid toward the full-line position 2A and then the ribbon cartridge is loaded in the printer from above.

Accordingly, in either case, the cartridge loading operation is very cumbersome.

Further, in cases where the printing portion 5 of the ribbon is slack in the free or non-loaded state thereof, it is difficult to turn the winding-side ribbon 2A for removal of such slack since the ribbon 2C is placed in frictional contact with the peripheral wall of the cartridge casing 6 under the bias of the torsion spring 3. As a result, it is preferable to turn the feeding side 4 of the ribbon in the rewinding direction and to this end, provision is needed for a knob by means of which the ribbon 4 can be turned. If, however, the printing portion 5 of the ribbon is damaged, rewinding of the feeding side 4 of the ribbon can not remove or remedy such damage, thus resulting in printing troubles.

On the other hand, although almost all thermal printing ribbons now in general use are one-time ribbons, it is expected in the near future that a multiuse or extended use ribbon reusable ten times or so will be developed and reduced to practice. In such a multiuse ribbon, the winding amount of the ribbon need not be greater than the return stroke of the printing head 7, and the ratio of the ribbon-winding amount to the printing head return stroke can be determined in accordance with the number of usable times required. However, this results in a change in rotation angle of the ribbon-feeding roller 1 and it is impossible to economically use the above-described two kinds of ribbons with the same printer.

Thus, the conventional ribbon cartridge for a printer as described above involves various disadvantages. Namely, the ribbon-feeding roller is costly and less productive; loading of the ribbon cartridge in a printer is troublesome and inefficient; slack in the printing ribbon can not be readily removed or remedied; and the ribbon cartridge has no satisfactory application with an extended use ribbon for the reason discussed immediately above and because of ribbon-feeding rollers of the type shown in FIG. 5 having projections on their outer peripheries.

SUMMARY OF THE INVENTION

Accordingly, the present invention is intended to obviate the above-described various disadvantages of the prior art, and has for its object the provision of a ribbon cartridge for a printer which is low in production cost and is applicable to various kinds of ribbons including one-time ribbons and multiuse ribbons, and in which loadability of the ribbon cartridge in a printer is improved, and in which it is easy to remedy slack in the printing portion of a ribbon.

In order to achieve the above object, according to the present invention, there is provided a ribbon cartridge for a printer which comprises:

a ribbon cartridge casing housing therein a ribbon-feeding means and a ribbon-winding means with a printing ribbon entrained therebetween, the cartridge casing having a lid member detachably secured thereto; and a ribbon-feeding roller having a projectionless outer periphery formed of a high friction material and adapted to be housed in the cartridge casing with a part thereof exposed outwardly of the cartridge casing, the ribbon-feeding roller being detachably supported by the cartridge casing and being placed in pressure engagement with the winding side of the ribbon wound around the ribbon-winding means.

It is preferred that the ribbon-feeding roller comprise a sleeve supported by the ribbon cartridge casing and releasably engageable with a drive shaft of a printer, and a roller member formed of the high friction material and fixedly mounted on the outer peripheral surface of the sleeve.

Preferably, the rollêr member is formed of rubber having a degree of hardness in the range from Hs 30 to 50 degrees.

The above and other objects, features and advantages of the present invention will become apparent from the following detailed description of a presently preferred embodiment of the invention when taken in conjunction with the accompanying drawings.

DESCRIPTION OF THE PREFERRED EMBODIMENT

Figure 1:
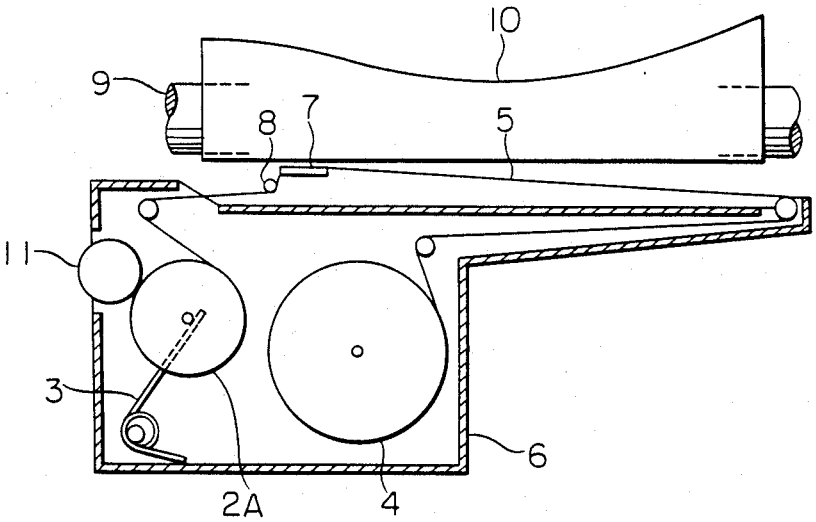
FIG. 1 is a plan view showing in cross section a general arrangement of a ribbon cartridge for a printer in accordance with the present invention.

FIGS. 1 through 4 show a presently preferred embodiment of the present invention. FIG. 1 is a plan view similar to FIG. 5, showing in cross section a general arrangement of a ribbon cartridge for a thermal printer of the present invention. The component parts of the ribbon cartridge other than a ribbon-feeding roller 11 illustrated in FIG. 1 are similar to those shown in FIG. 5 and identified by the same reference numerals as employed in FIG. 5, and thus any detailed description of the same component parts as in FIG. 5 will be unnecessary.

According to the present invention, the ribbon-feeding roller 11 has its outer periphery formed of a high friction material such as rubber having a low degree of hardness, and is housed in a ribbon cartridge casing 6 together with a winding side 2A of a ribbon, a feeding side 4 of the ribbon and a printing portion 5 of the ribbon.

Figure 2:
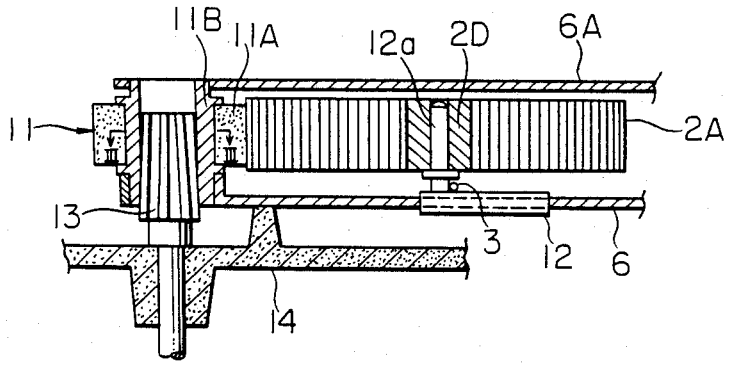
FIG. 2 is a front elevational cross section showing essential parts of the ribbon cartridge.
Figure 3:
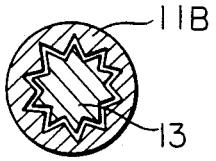
FIG. 3 is a a cross sectional view taken along the line III—III in FIG. 2.

As pictured in detail in FIG. 2, the ribbon-feeding roller 11 comprises a roller member 11A formed of a high friction material such as rubber and a sleeve 11B firmly mounting thereon the roller member 11A, the sleeve 11B being freely rotatably supported at its opposite ends by the cartridge casing 6 and a lid member 6A, respectively. The lid member 6A is detachably secured to the casing 6.

A drive shaft 13 is rotatably supported by a base 14 of a printer and is adapted to be inserted into the sleeve 11B for driving thereof. As clearly seen from FIG. 3, the drive shaft 13 is formed on its outer peripheral surface with a plurality of axially extending teeth which, when inserted into the sleeve 11B, are in meshing engagement with a plurality of corresponding axially extending teeth formed in the inner peripheral surface of the sleeve 11B for integral rotation therewith. In this manner, the drive shaft 13 is releasably engageable with the sleeve 11B.

Figure 4:
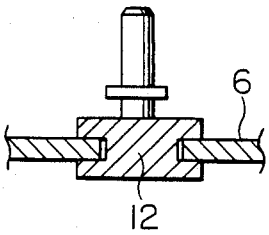
FIG. 4 is a partial cross sectional view showing a slider slidably mounted on the side wall of a cartridge casing.
Figure 5:
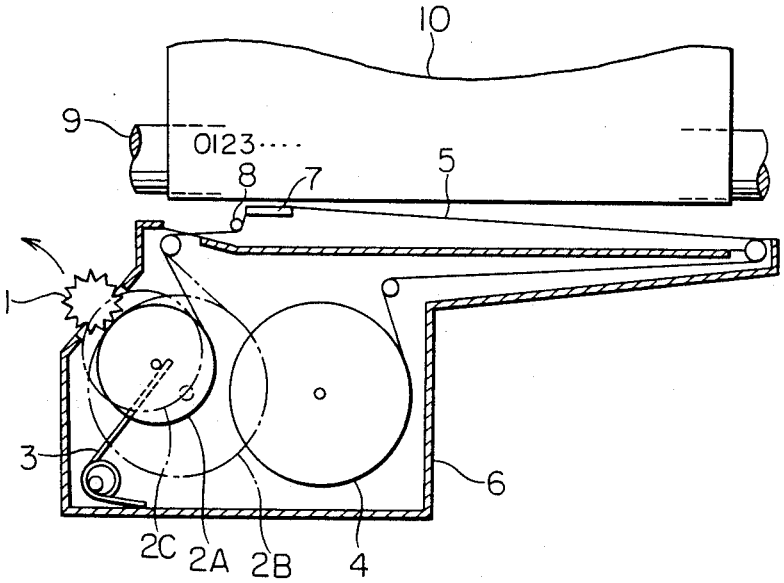
FIG. 5 PRIOR ART
FIG. 5 is a plan view similar to FIG. 1 showing a general arrangement of a conventional ribbon cartridge for a printer.

As shown in FIG. 2, the winding side 2A of the ribbon has a core 2D which is rotatably mounted on a support pin 12a fixedly secured to a slider 12 which is attached to the side wall of the cartridge casing 6 for sliding movement relative thereto in a direction toward and away from the ribbon-feeding roller 11, as depicted in detail in FIG. 4. The slider 12 is biased by means of a coiled torsion spring 3 in a direction toward the ribbon-feeding roller 11 whereby the winding side 2A of the ribbon is placed into pressure engagement with the roller member 11A.

In this connection, it is to be noted that the roller member 11A is formed of rubber of a low degree of hardness, for example, in the range from Hs 30 to 50 degrees, so that there will be created a satisfactory frictional force between the ribbon and the roller. As illustrated in FIGS. 1 and 2, a part of the roller member 11A is exposed outwardly of the cartridge casing 6.

With the above-described arrangement, the drive shaft 13 rotatably supported by the base 14 of the thermal printer is driven to rotate in the counterclockwise direction in FIG. 1 during the returning stroke of the printing head 7 so that the ribbon-feeding roller 11, being in meshing engagement with the drive shaft 13, is likewise caused by the drive shaft 13 to rotate in the counterclockwise direction, thus effecting a ribbon winding operation similar to that in the conventional ribbon cartridge illustrated in FIG. 5.

Further, when the ribbon cartridge is in a free or non-loaded condition, an operator can directly turn the ribbon-feeding roller 11 so as to wind the winding side 2A of the ribbon, thus removing any slack in the printing portion 5 of the ribbon without difficulty. In addition, it is easy to load the ribbon cartridge in a printer since there is no need for the ribbon-feeding roller 11 to be pushed in the cartridge casing. Also, it is possible to replace a worn-out ribbon-feeding roller with a new one simply by removing the lid member 6A from the cartridge casing 6.

As described in the foregoing, according to the present invention, the ribbon-feeding roller is formed of rubber and housed in the cartridge casing with a portion thereof exposed outwardly of the cartridge casing, and the lid member can be detachably secured to the cartridge casing. With this arrangement, the ribbon-feeding roller can be produced at low cost, and it is easy not only to load the ribbon cartridge in a printer but also to remedy or remove any slack of the ribbon. Moreover, due to the fact that it is possible to effect replacement of the ribbon-feeding roller, a one-time ribbon can be replaced with a multiuse ribbon so that the multiuse ribbon can be used with the same printer.

It will be readily understood to the skilled in the art that although the above description has been made of a ribbon cartridge for a thermal printer, the principles of the present invention will be similarly applicable to a ribbon cartridge for printers of general purposes.

What is claimed is:

1. A ribbon cartridge for a printer comprising:

a ribbon cartridge casing housing therein a ribbon-feeding means and a ribbon-winding means with a printing ribbon entrained therebetween, said cartridge casing having means for enabling replacement of the contents of said cartridge comprising a detachable and replaceable lid member;

a ribbon-feeding roller having a projectionless outer periphery formed of a high friction rubber material and, said ribbon-feeding roller being detachably and replaceably mounted in said cartridge casing, part of the ribbon-feeding roller being exposed outwardly of said cartridge casing and part of said ribbon-feeding roller being in pressure engagement with the winding side of the ribbon wound around said ribbon-winding means.

2. A ribbon cartridge for a printer as claimed in claim 1, wherein said ribbon-feeding roller comprises a sleeve supported by said ribbon cartridge casing and being releasably engageable with a coaxially arranged drive shaft of a printer, and a roller member formed of the high friction material and fixedly mounted on the outer peripheral surface of said sleeve.

3. A ribbon cartridge for a printer as claimed in claim 2, wherein said roller member is formed of rubber having a degree of hardness in the range from Hs 30 to 50 degrees.

4. A ribbon cartridge for a printer as claimed in claim 1 wherein said ribbon-feeding means and said ribbon-winding means are in spaced relationship.

* * * * *